US007438299B2

(12) United States Patent
Vera

(10) Patent No.: US 7,438,299 B2
(45) Date of Patent: Oct. 21, 2008

(54) PORTABLE ENCLOSURE

(76) Inventor: Jude C. Vera, 5124 Gateway Dr., Tampa, FL (US) 33615

( * ) Notice: Subject to any disclaimer, the term of this patent is extended or adjusted under 35 U.S.C. 154(b) by 354 days.

(21) Appl. No.: 11/167,388

(22) Filed: Jun. 27, 2005

(65) Prior Publication Data

US 2006/0289131 A1 Dec. 28, 2006

(51) Int. Cl.
*B60J 7/00* (2006.01)

(52) U.S. Cl. ..... 280/79.2; 296/136.01; 150/166

(58) Field of Classification Search ..... 280/79.2, 280/79.3, 79.11, 47.131, 35, 63, 47.17, 47.26, 280/64; 224/414; 150/166, 167, 154, 157–8; 296/100.01, 98, 136.1, 136.01–136.02; 135/115, 135/904; 248/129; 206/335
See application file for complete search history.

(56) References Cited

U.S. PATENT DOCUMENTS

| | | | | | |
|---|---|---|---|---|---|
| 3,621,858 | A | * | 11/1971 | Steele | 135/87 |
| 3,884,523 | A | * | 5/1975 | Allen | 296/136.04 |
| 4,718,711 | A | | 1/1988 | Rabbit | 296/136 |
| 4,792,040 | A | | 12/1988 | Wagstaff, III | 206/223 |
| 4,856,842 | A | | 8/1989 | Ross et al. | 296/136 |
| 4,925,234 | A | | 5/1990 | Park et al. | 296/136 |
| 5,029,933 | A | | 7/1991 | Gillem | 296/136 |
| 5,040,557 | A | | 8/1991 | Morgan | 135/88 |
| 5,052,738 | A | * | 10/1991 | Li | 296/78.1 |
| 5,066,065 | A | | 11/1991 | Baughman | 296/165 |
| 5,088,788 | A | * | 2/1992 | Moulton | 296/136.04 |
| 5,094,257 | A | | 3/1992 | Wilson et al. | 135/88 |
| 5,112,098 | A | | 5/1992 | Lichtmann | 296/136 |
| 5,161,849 | A | | 11/1992 | Holland, Jr. | 296/95.1 |
| 5,176,421 | A | | 1/1993 | Fasiska | 296/136 |
| 5,275,460 | A | | 1/1994 | Kraus | 296/136 |
| 5,343,915 | A | | 9/1994 | Newsome | 150/166 |
| 5,409,286 | A | | 4/1995 | Huang | 296/136 |
| 5,567,002 | A | | 10/1996 | Tair | 296/136 |
| 5,597,196 | A | | 1/1997 | Gibbs | 296/98 |
| 5,855,406 | A | | 1/1999 | Vargo | 296/136 |
| 6,032,963 | A | * | 3/2000 | Daugherty | 280/47.26 |
| 6,092,857 | A | | 7/2000 | Rivas | 296/136 |
| 6,276,381 | B1 | | 8/2001 | O'Brien | 135/87 |
| 6,513,858 | B1 | | 2/2003 | Li et al. | 296/136 |
| 6,588,827 | B2 | | 7/2003 | Heiland | 296/136 |
| 2005/0269792 | A1 | * | 12/2005 | Aronson | 280/79.11 |

* cited by examiner

*Primary Examiner*—Christopher P. Ellis
*Assistant Examiner*—Vaughn T Coolman
(74) *Attorney, Agent, or Firm*—Holland & Knight LLP

(57) ABSTRACT

A portable enclosure, including a thin flexible cover for covering an object and protecting it from the environment, a storage cassette for removably storing said cover therein, a wheeled carriage for removably receiving the storage cassette, whereby the storage cassette either may be transported by the wheeled carriage to a position close to the object whereupon the cover may be removed from the storage cassette and placed over the object or may be removed from the wheeled carriage such that the storage cassette and the cover therein may be used in a location distant from the wheeled carriage.

22 Claims, 3 Drawing Sheets

PORTABLE ENCLOSURE

BACKGROUND OF THE INVENTION

1. Field of the Invention

This invention relates to portable enclosures. More particularly, this invention relates to enclosures for covering an automobile, snowmobile, patio furniture or other objects with a light-weight cover to protect the object from the environment.

2. Description of the Background Art

Presently there exist many types of enclosures for covering automobiles, snowmobiles, patio furniture, plants and other objects to protect them from the environment such as precipitation or excessive heat or cold. Representative patents relating to enclosures include:

| | | |
|---|---|---|
| U.S. Pat. No. 6,276,381 | U.S. Pat. No. 6,513,858 | U.S. Pat. No. 6,092,857 |
| U.S. Pat. No. 5,855,406 | U.S. Pat. No. 5,597,196 | U.S. Pat. No. 5,567,002 |
| U.S. Pat. No. 5,343,915 | U.S. Pat. No. 5,275,460 | U.S. Pat. No. 5,176,421 |
| U.S. Pat. No. 5,161,849 | U.S. Pat. No. 5,094,257 | U.S. Pat. No. 5,040,557 |
| U.S. Pat. No. 4,856,842 | U.S. Pat. No. 4,792,040 | U.S. Pat. No. 4,925,234 |
| U.S. Pat. No. 5,029,933 | U.S. Pat. No. 5,066,065 | U.S. Pat. No. 4,718,711 |
| U.S. Pat. No. 6,588,827 | U.S. Pat. No. 5,409,286 | U.S. Pat. No. 5,112,098 |

The above-listed patents teach automotive enclosures and covers that are limited in utility. Some employ lightweight fabrics and are therefore highly portable. Unfortunately, being so light, they cannot be stored adjacent to the automobile so that they can be conveniently used when needed to cover the automobile. Others enclosures comprise permanent structures that cannot be easily transported.

Thus, there is a need in the marketplace for a storage enclosure for an automobile cover that is portable with a water compartment to add weight to the enclosure so that it may on the one hand be emptied of water and conveniently placed in the automobile's trunk or, on the other hand, filled with water to add weight so that it can be semi-permanently placed next to the automobile for repeated daily use without concern that it might otherwise be blown away.

Therefore, it is an object of this invention to provide an improvement which overcomes the aforementioned inadequacies of the prior art and provides an improvement which is a significant contribution to the advancement of the portable enclosure art.

Another object of this invention is to provide a storage cassette for storing a cover, the storage cassette being carried by a wheeled carriage.

Another object of this invention is to provide a wheeled carriage for a storage cassette in which the carriage is weighted by an integral water compartment.

Another object of this invention is to provide a storage cassette and wheeled carriage therefore in which the storage cassette is operatively coupled to the wheeled carriage permitting the opening of the cassette and removal of the cover stored therein.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a storage cassette in which is stored a lightweight cover for covering automobiles and other vehicles, watercraft, plants, fixtures such as hot tubs and other outdoor objects normally exposed to the environment to protect them from inclement weather such as precipitation or excessive heat or cold.

The storage cassette of the invention comprises a water compartment that is fillable with water to add weight. With the water compartment empty, the storage cassette can be conveniently placed in the automobile's trunk and when desired to be used, simply removed from the trunk and placed next to the automobile whereupon the lightweight cover may be extracted from the cassette and draped over the automobile to cover the same. When the water compartment is filled with water, the storage cassette is heavy enough to be left semi-permanently in place adjacent to the automobile. The invention further includes a weighted wheeled carriage for convenient transport of the storage cassette.

For quick errands, such as quick trips to the grocery store or the like, the driver of the automobile may quickly remove the cover and stuff it into the enclosure. Upon returning from the trip, the cover may be pulled from the enclosure and placed to recover the automobile. The enclosure includes wheels such that, for longer trips, the enclosure may be wheeled into the garage for temporary storage until the automobile trip is over.

An important feature of the present invention is the fact that the water compartment may be emptied of water. Once emptied, the enclosure is light enough to be easily lifted into the trunk of the automobile.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other apparatuses and methods for carrying out the same purposes of the present invention. It should also be realized by those skilled in the art that such equivalent apparatuses and methods do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 1:
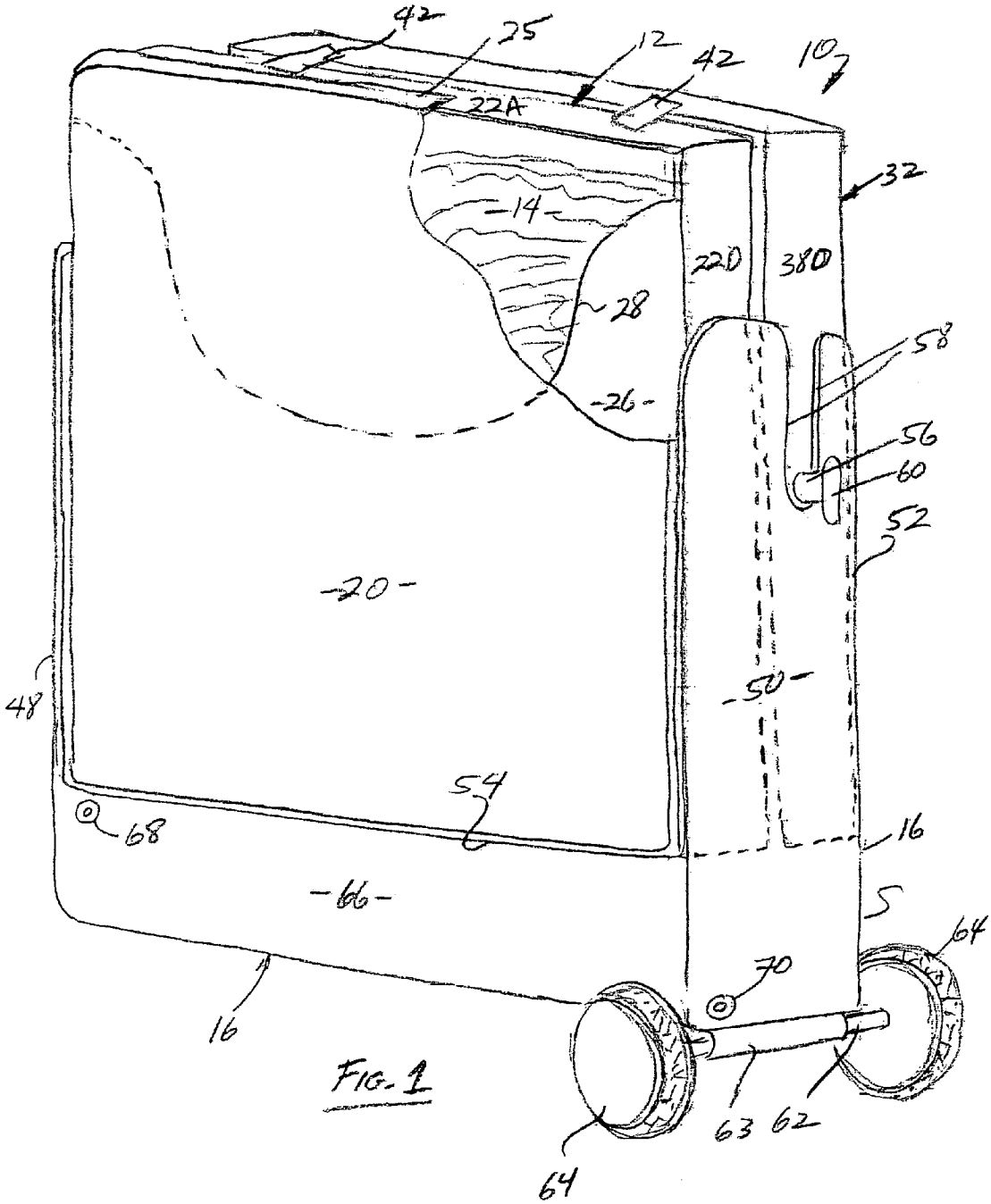
FIG. 1 is a perspective view, partially cut-away, of the portable enclosure of the invention comprising a storage cassette in which is stored an automobile cover or the like which is operatively coupled to a wheeled carriage for transporting thereof.
Figure 2:
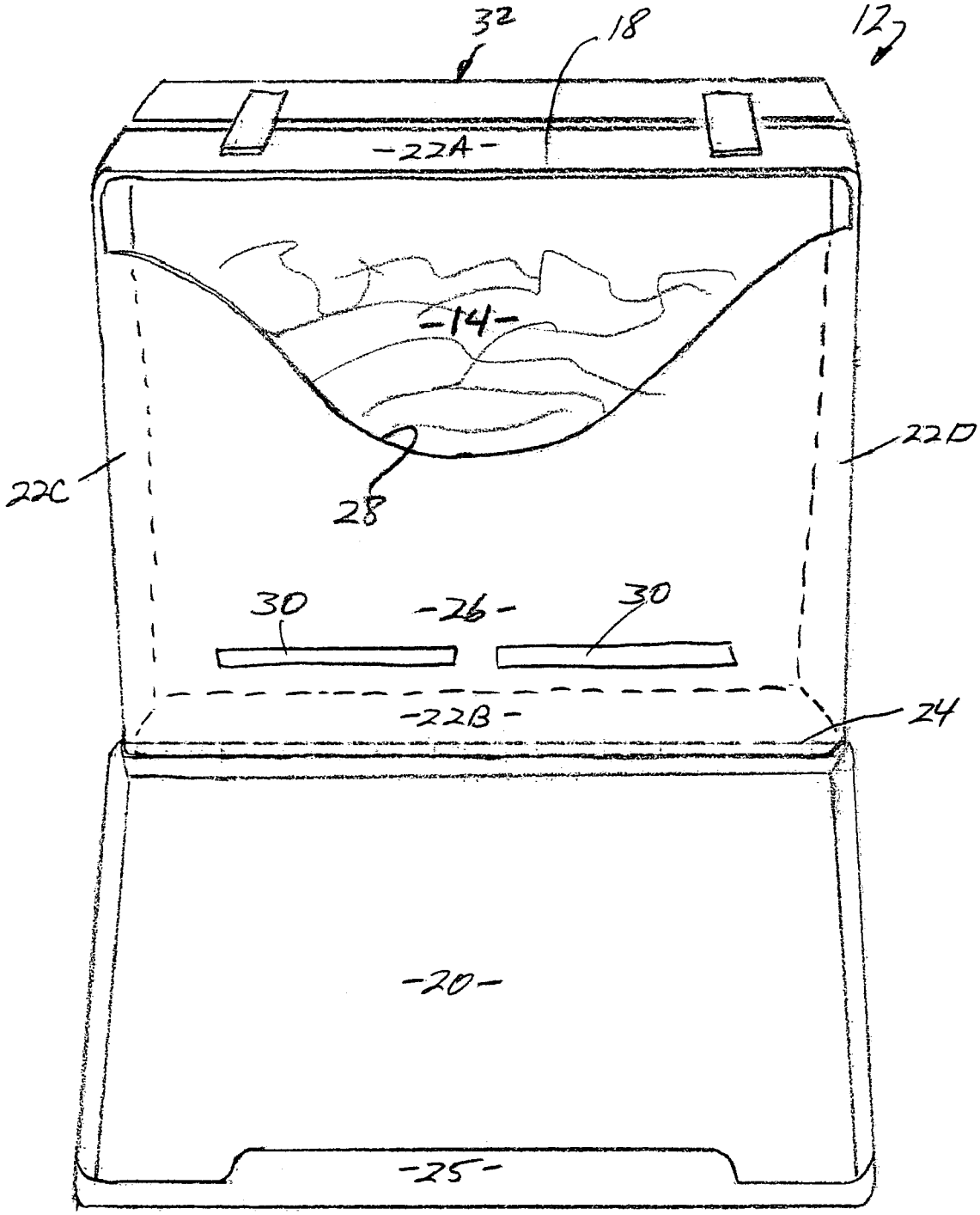
FIG. 2 is a perspective view of the storage cassette of the invention with its front wall open to allow removal of the cover stored therein.
Figure 3:
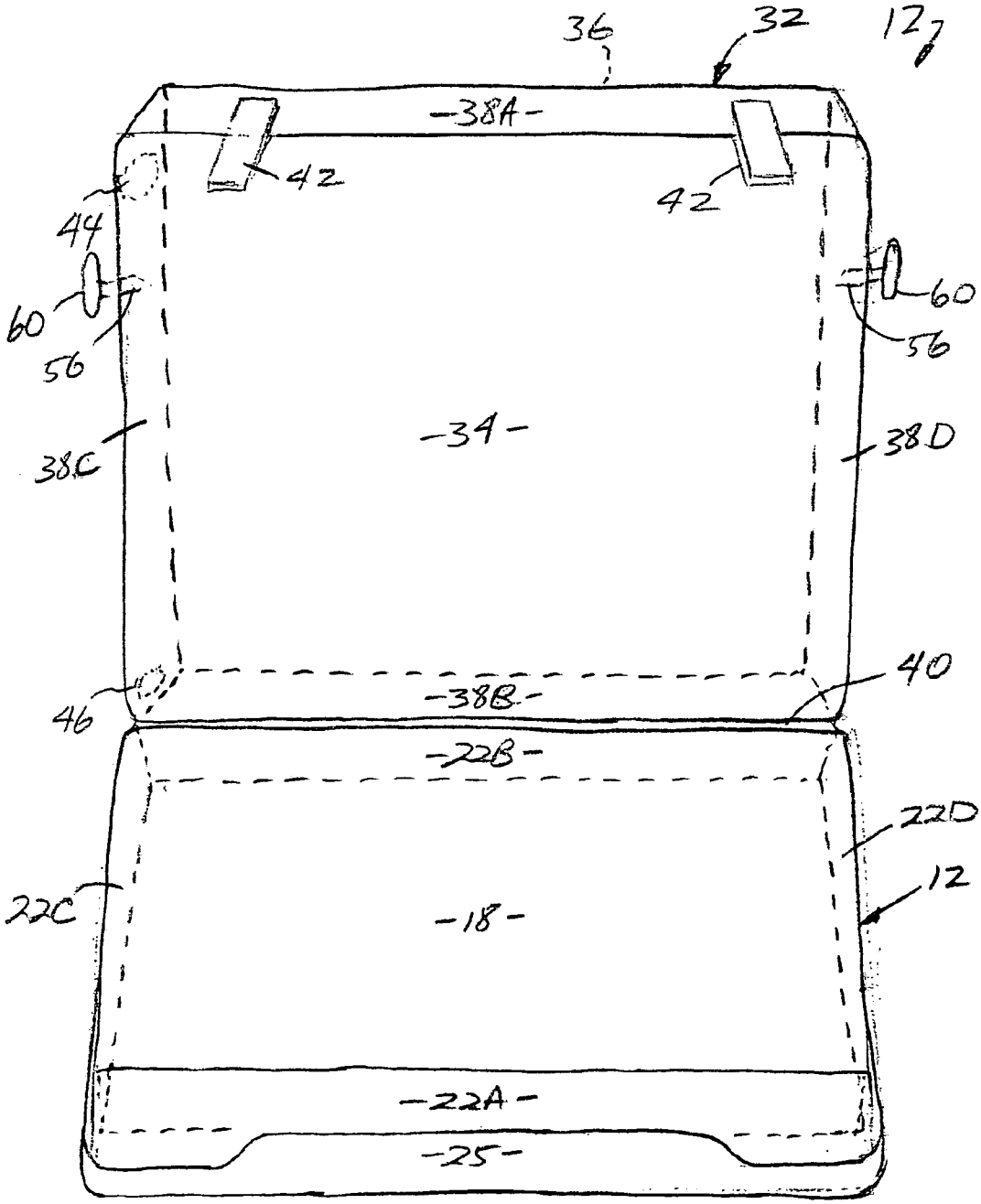
FIG. 3 is a perspective view of the water compartment hingely connected to the rear of the storage cassette.

Referring to FIGS. 1-3, the invention comprises a portable enclosure, generally indicated by numeral 10 including a storage cassette 12 for containing a cover 14 and a wheeled carriage 16 for carrying the storage cassette 12.

More particularly, as best shown in FIG. 2, the storage cassette 12 of the invention preferably comprises a generally rectangular design defined by a rear wall 18, front wall 20 and four side walls 22A, 22B, 22C and 22D. The front wall 20 is configured to be removable so as to gain access to the interior of the storage cassette 12. Such removability may be achieved by means of a hinge 24 interconnecting the front wall 20 with the bottom side wall 22B and a latch 25 is provided at the top of the front side wall 20 for snap fastening to the top side wall 22A. The storage cassette 12 further includes a partial inner wall 26 having an upper arcuate edge 28 and longitudinal ventilation slots 30. The partial inner wall 26 with its arcuate edge 28 serves to retain the cover 14 within the cassette 12 when the front wall 20 is opened while allowing the cover 14 to drip dry via the ventilation slots 30 during storage and to allow the cover 14 to be easily removed for use.

As best shown in FIG. 3, the storage cassette 12 may further include a water compartment 32 having a surface area in a configuration corresponding to the rear wall 18 of the storage cassette 12. The water compartment 32 comprises a watertight structure defined by front and rear walls 34 and 36 and side walls 38. Preferably, the water compartment 32 is coupled to the storage cassette 12 such as by means of a hinge 40 extending along the longitudinal front edges of the bottom side wall 22B and 38B and of the cassette 12 and water compartment 32, respectively. Snap latches 42 are provided for latching the water compartment 32 to the storage cassette 12 in a parallel configuration when closed. The water compartment 32 comprises a fill port 44 allowing it to be filled with water and a drain 46 allowing it to be drained of water.

Returning now to FIG. 1, the wheeled carriage 16 of the invention comprises a generally rectangular configuration including opposing side walls 48 and 50, a rear wall 52 and a bottom wall 54 defining an opened-front rectangular opening for receiving the storage cassette 12 and water compartment 32 therein. Preferably, the storage cassette 12 is operatively coupled to the wheeled carriage 16 by means of a tongue and groove configuration including a pin 56 extending from the opposing sides 38C and 38D of the water compartment 32 that slidably engages into corresponding slots 58 formed in the opposing side walls 48 and 50 of the wheeled carriage 16. Preferably, a head 60 is formed on the end of the pin 66 to engage the outmost surface of the opposing side walls 48 and 50 of the wheeled carriage 16.

The wheeled carriage 16 further comprises an axle 62 journalled 63 to the wheeled carriage 16 in a position substantially transversely to the carriage 16. Rotatably coupled to the axle 62 is a pair of wheels 64. The wheeled carriage 16 may optionally include a water compartment 66 formed underneath the bottom wall 54. The water compartment 66 may include a fill port 68 for filling the compartment 66 and a drain 70 for draining the compartment 66.

During use, the wheeled carriage 16 with the storage cassette 12 mounted therein, may be conveniently stored in a suitable location such as a garage. When it is desired to be used, it may be conveniently wheeled to the desired location, such as the driveway, patio, the backyard, etc. If excessive wind is of concern, the water compartment 66 of the wheeled carriage 16 may be filled with water to add weight to the carriage 16 and reduce the likelihood that it would be blown over by high winds. While still in the wheeled carriage 16, the storage cassette 12 may be opened by unlatching the latch 25 and pivoting the front wall 20 open to expose the inner wall 26. The cover 14 contained therein may then be easily removed from the cassette 12 and placed in use as desired. It is noted that the cassette 12 may be optionally removed from the carriage and laid on the ground and the wheeled carriage 16 returned to its storage place, such as the garage. If it is desired to leave the storage cassette 12 on the ground for an extended period of time, the water compartment 32 may be filled with water to add weight to it to keep it from being blown by excessive winds. In any event, while in such a semi-permanent location, the front wall 20 may be at any time lifted to gain access to the cassette 12 such that the cover 14 may be removed. Of course, when it is desirous to store the cassette 12, the wheeled carriage 16 may be retrieved from the garage, the storage cassette 12 loaded therein and then both returned together to the garage. Of course, before each transport, one or both of the water compartments 32 and 66 may be emptied via their respective drains 46 and 70.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and steps and the combination and arrangement of parts and steps may be resorted to without departing from the spirit and scope of the invention.

I claim:

1. A portable enclosure, comprising in combination:

a thin flexible cover for covering an object and protecting it from the environment;

a storage cassette for removably storing said cover therein;

a wheeled carriage for removably receiving said storage cassette;

a weight supported by said wheeled carriage such that said wheeled carriage may remain in position adjacent the object without being inadvertently blown away by wind, said weight comprising water positioned within a water compartment formed within said wheeled carriage;

whereby said storage cassette either may be transported by said wheeled carriage to a position close to the object whereupon said cover may be removed from said storage cassette and placed over the object or may be removed from said wheeled carriage such that said storage cassette and said cover therein may be used in a location distant from said wheeled carriage.

2. The portable enclosure as set forth in claim 1, wherein said storage cassette comprise a front portion and a back portion hinged together, said front and back portion defining a space for receiving said cover.

3. The portable enclosure as set forth in claim 2, wherein said storage cassette further includes a latch.

4. The portable enclosure as set forth in claim 3, wherein a front area of said wheeled carriage is unobstructed such that said front portion of said storage cassette while inserted in said wheeled carriage may be opened upon release of said latch.

5. The portable enclosure as set forth in claim 4, further including a inner wall with an arcuate upper edge for restraining said cover while in said storage cassette yet allowing convenient removal.

6. The portable enclosure as set forth in claim 5, wherein said inner wall comprises a ventilation slot.

7. The portable enclosure as set forth in claim 5, wherein said inner wall comprises a drain.

8. The portable enclosure as set forth in claim 1, wherein said storage cassette is operatively coupled to said wheeled carriage.

9. The portable enclosure as set forth in claim 8, wherein said wheeled carriage includes opposing end walls defining a space for receiving said storage cassette therebetween.

10. The portable enclosure as set forth in claim 9, wherein said wheeled carriage further includes a rear wall for further defining said space for receiving said storage cassette.

11. The portable enclosure as set forth in claim 8, wherein said storage cassette is operatively coupled to said wheeled carriage by a tongue and groove assembly.

12. The portable enclosure as set forth in claim 11, where said tongue and groove assembly comprises a pin extending from an end of said storage cassette that slides within a corresponding slot formed in an upstanding wall of said wheeled carriage.

13. The portable enclosure as set forth in claim 12, wherein said pin comprises a head that engages an outer surface proximate to said slot to preclude said cassette from moving laterally relative to said wheeled carriage.

14. The portable enclosure as set forth in claim 1, wherein said wheeled carriage comprises a wheeled assembly including an axel and at least one wheel mounted therein, said wheeled assembly being rotatably journalled to an underside of said wheeled carriage.

15. The portable enclosure as set forth in claim 14, further comprising a pair of said wheels.

16. The portable enclosure as set forth in claim 15, where said axel is positioned transversely to a long axis of said wheeled carriage.

17. The portable enclosure as set forth in claim 1, wherein said storage cassette further includes a drain.

18. The portable enclosure as set forth in claim 1, wherein said wheeled carriage water compartment comprises a fill port and a drain allowing said wheeled carriage water compartment to be filled with water and drained of water as desired.

19. A portable enclosure, comprising in combination:

a thin flexible cover for covering an object and protecting it from the environment;

a storage cassette for removably storing said cover therein;

a wheeled carriage for removably receiving said storage cassette;

a weight supported by said storage cassette such that said storage cassette may be removed from said wheeled carriage and placed in position adjacent the object without be being inadvertently blown away by wind, said weight of said storage cassette comprising water positioned within a storage cassette water compartment connected to said storage cassette;

whereby said storage cassette either may be transported by said wheeled carriage to a position close to the object whereupon said cover may be removed from said storage cassette and placed over the object or may be removed from said wheeled carriage such that said storage cassette and said cover therein may be used in a location distant from said wheeled carriage.

20. The portable enclosure as set forth in claim 19, wherein said storage cassette water compartment comprises a fill port and a drain allowing said storage compartment water compartment to be filled with water and drained of water as desired.

21. The portable enclosure as set forth in claim 20, wherein said storage cassette water compartment is pivotally connected to said back portion.

22. The portable enclosure as set forth in claim 20, wherein said storage cassette and said storage cassette water compartment comprise substantially the same area such that said storage cassette and said storage cassette may be hinged together and secured together by means of a latch.

* * * * *